United States Patent [19]

Rogers et al.

[11] Patent Number: 4,658,448

[45] Date of Patent: Apr. 21, 1987

[54] PROCESS AND APPARATUS FOR HEATING BATHS AND THE LIKE

[76] Inventors: Jerry W. Rogers, P.O. Box 16764, Mobile, Ala. 36616; Frankin R. Rogers, 4 Christine Cir., Mobile, Ala. 36609; R. Wayne Jacobs, 1947 Staples Rd., Mobile, Ala. 36605

[21] Appl. No.: 798,880

[22] Filed: Nov. 18, 1985

[51] Int. Cl.[4] ..... F24H 1/20

[52] U.S. Cl. ..... 4/493; 126/350 D

[58] Field of Search ..... 4/493, 492, 591, 545, 4/DIG. 9, 489, 544; 126/366, 350 D; 210/169

[56] References Cited

U.S. PATENT DOCUMENTS

| | | | |
|---|---|---|---|
| 1,723,981 | 8/1929 | Garcia | 4/545 |
| 1,839,156 | 12/1931 | Lumpkin | 4/DIG. 6 |
| 4,225,984 | 10/1980 | Lindsey | 4/544 |
| 4,233,694 | 11/1980 | Janosko et al. | 4/493 |

FOREIGN PATENT DOCUMENTS

| | | | |
|---|---|---|---|
| 2307946 | 8/1974 | Fed. Rep. of Germany | 4/493 |
| 745564 | 5/1933 | France | 4/545 |
| 368594 | 2/1939 | Italy | 4/545 |
| 198638 | 11/1983 | Japan | 126/350 D |
| 60-145 | 4/1984 | Japan | 126/350 |

*Primary Examiner*—Stephen Marcus
*Assistant Examiner*—Leo Peters
*Attorney, Agent, or Firm*—George L. Williamson

[57] ABSTRACT

A method, system and apparatus having a spa shell or like vessel containing water or like liquid, a water heating element, a heat chamber molded into the seat of said spa, said seat having conduits therein for the passage of water from the heat chamber to the spa shell, said heat chamber having conduits provided therein which are connected to the heater element which heater element would consist of a commercially and generally available home electrical or gas water heater, with said liquid contents of said spa shell being circulated by a pump whereby the water is pumped from said heat chamber to the interior of the spa shell.

3 Claims, 5 Drawing Figures

PROCESS AND APPARATUS FOR HEATING BATHS AND THE LIKE

BACKGROUND OF THE INVENTION

The present invention generally related to the field of spas and tubs and, more particularly, to an apparatus and method for more economically heating same.

Devices for heating baths, tubs, spas and other water receptacles and the like have been described in the prior art. Many combinations of tubs, vessels, spas, piping, valving, and heating mechanisms are available in the marketplace. However, none of the prior art embody the features of the present invention. Gwynn and Spencer, U.S. Pat. No. 520,880, described a tub which could be readily heated whereby the water therein would be maintained at a high degree of temperature. Carter, U.S. Pat. No. 1,074,694, described an improved bath with means of heating the upper portion of the bath tub around its top edge.

Lawler, U.S. Pat. No. 1,079,775, described an invention for heating tubs by means of having a hot water pipe in close contact with the rim of said tub. Marston, U.S. Pat. No. 541,371, described an improvement in tubs whereby the water within the tub was maintained at a uniform temperature by providing automatic cut-off means to the hot or cold water supply for said tub. Sahloff, U. S. circulating jacket whereby hot water was circulated about the tub.

SUMMARY OF THE INVENTION

The present invention relates to a process, system and apparatus for providing a heated vessel of water wherein one can immerse himself. The present invention comprises a spa shell for the placement of the water therein, a water heating element, a heat chamber integrally molded into the spa shell having appertures therein for the passage of water between said heating element and said spa shell and water pumps for transportating water between the heating element and the heat transfer conduits, and between the heat chamber and the interior of the spa shell. The spa shell would be conveniently sized for use in the home. Furthermore, the heating element could be comprised of an electrical or gas water heater such as the type normally found in a residence.

The primary objective of the invention is the provision of a process, system and apparatus for maintaining water in a spa of relatively high temperature, but for a nominal cost. Tests conducted on a model installation indicate that the present invention can be operated at a fraction of the cost required for the operation of the spas generally available in the marketplace having different types of water heaters than that proposed for the present invention. A further objective of the present invention is to provide an apparatus which will be cheaper to manufacture and install because it uses a hot water heater such as normally found in a residence. Also, the water heater may be installed prior to the spa.

These and various other objects and advantages of the invention will become readily apparent to those skilled in the art upon reading the following detailed descriptions and claims and by referring to the accompanying drawings. The above objects are obtained in accordance with the present invention by the provision of a combination of elements fabricated in a manner substantially described in the above summary and the following additional description.

DESCRIPTION OF THE PREFERRED EMBODIMENT(S)

Figure 1:
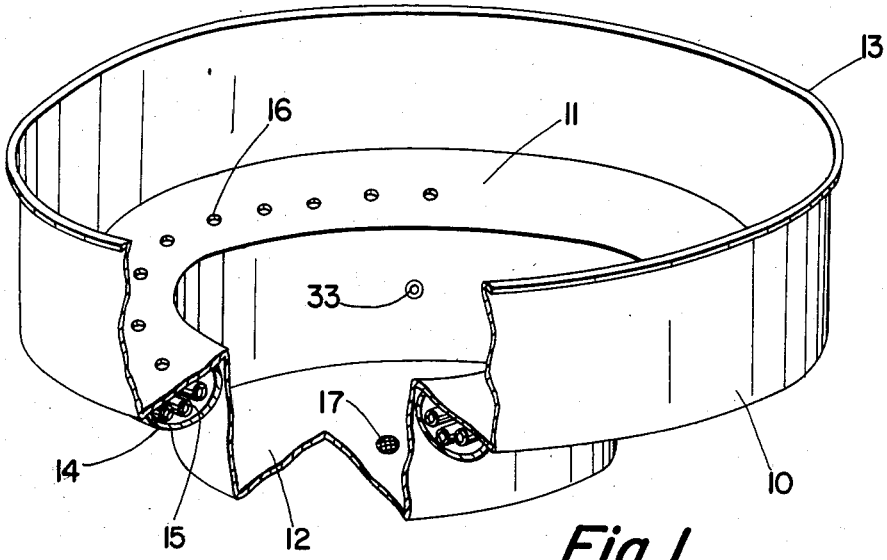
FIG. 1. A sectioned perspective of the invention is shown.

Turning now to the drawings, more particularly FIG. 1, the invention is shown in perspective with the spa shell designated as 10. In FIG. 1, the spa shell is constructed so that a seat-like area, 11, is provided on the inside of the spa shell, said shell additionally having a bottom, 12. The upper edge of the vertical walls of the shell is provided with a rim, 13, upon which one using the spa can rest his arm. The spa shell could be a tub, bath, vessel or other like water receiving receptacle.

A heat chamber, 14, containing conduits for the passage of water and thereby heat transfer, 15, is connected to the spa seat, 11. The spa seat, 11, is provided with appertures, 16, for water passage being located on only one-half of its diameter through which higher temperature water from the heat chamber would pass and be mixed with the cooler water already contained in the main spa shell, 10. The spa shell, 10, would also have a drain, 17, located in its bottom.

Figure 2:
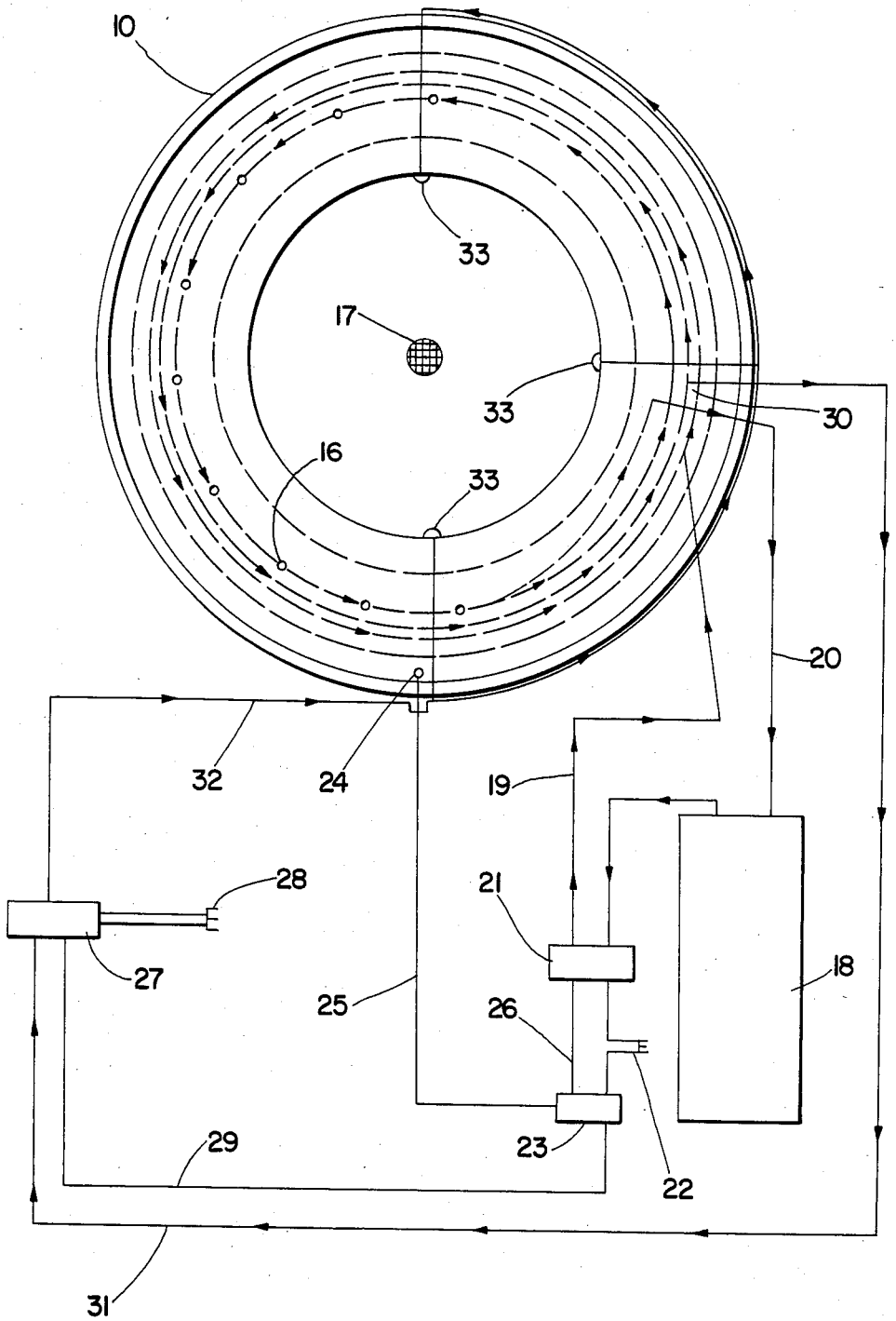
FIG. 2. A schematic diagram of the invention is shown.

A review of FIG. 2 will demonstrate the unique operational features of the present invention. In FIG. 2, the spa shell is generally depicted, 10, along with the water heating element, 18, for the spa. The water heating element, 18, is expected to comprise a conventional electrical or gas home hot water heater as is in general use in residences throughout the United States. It would be expected that the water heating element, 18, would have a capacity in the neighborhood of 40–60 gallons. This type heater would be of relatively low BTU output and low power consumption compared to the spa heaters which are now used in the prior art. Water, or other liquid, from the heating element, 18, is transferred to the heat transfer conduit, 15, by means of an input flow line, 19. Additionally, an output flow line, 20, is provided to transfer water from the heat transfer conduit, 15, back to the water heating element, 18. It is important to note that the input and output flow lines, 19 and 20, and the heat transfer conduits, 15, are closed. This is necessary for public health reasons in order to prevent any biological, chemical or physical contamination of the water supply contained in the water heating element, 18, which water supply would be used for other home purposes such as bathing, cooking, and/or drinking.

In FIG. 2, water is circulated through the water heating element, 18, and the heat transfer conduit, 15, by a small water pump, 21, with power being supplied thereto by any appropriate means, 22. The water pump, 21, is controlled by a thermostat, 23, having a water temperature sensor, 24, located inside the spa shell in contact with the water held therein. Likewise, electrical connecting means, 25 and 26, are supplied between the water temperature sensor, the thermostat, the power supply and the water pump. Expected operating temperature of the water vessel is about 104 degrees Fahrenheit.

In FIG. 2, a spa-water circulator pump, 27, is shown having a power supply, 28, thereto, which spa-water circulator pump is activated by a thermostat, 23, being provided with suitable electrical connecting means, 29, between the spa-water circulator pump and the thermostat. The spa-water circulator pump, 27, transfers water from the heat chamber, 14, to the interior of the spa shell. This is accomplished by providing an outlet means, 30, through the wall of the heat chamber, 14, which outlet means is connected to the spa-water circulator pump, 27, through an output flow line, 31. Likewise, an input flow line, 32, transfers water from the spa-water circulator pump, 27, to the interior of the spa shell and discharges through an inlet means, 33. It is important to note that the appertures, 16, in the spa seat, 11, are arranged so that said appertures are situated in the spa shell so as to be opposite to or at right angles to the inlet means, 33, with respect to the spa shell, 10. The purpose of this arrangement is to provide maximum mixing of the water in the spa shell having a temperature differential so as to maximize the heat transfer efficiency of the system.

Figure 3:
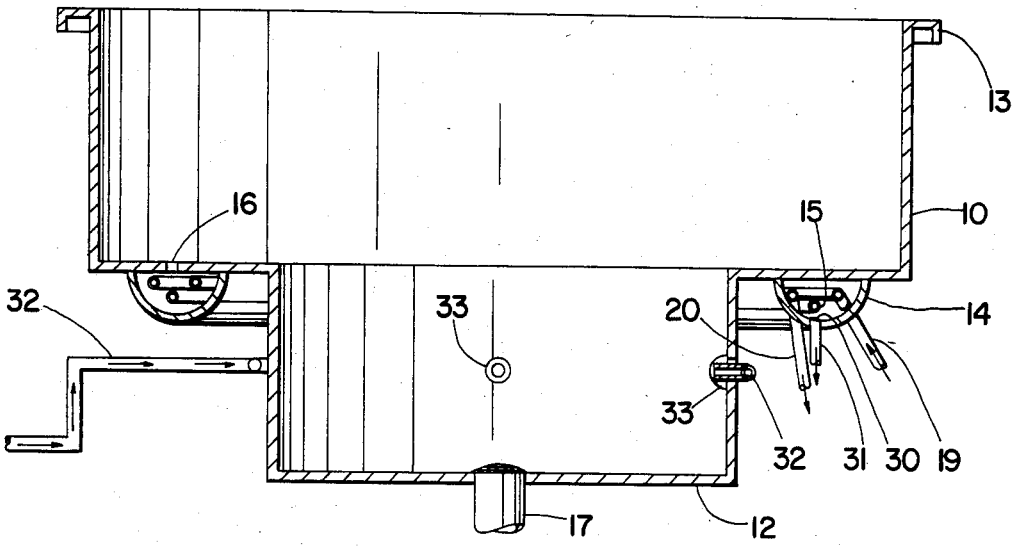
FIG. 3. A sectional view of the invention is shown.
Figure 4:
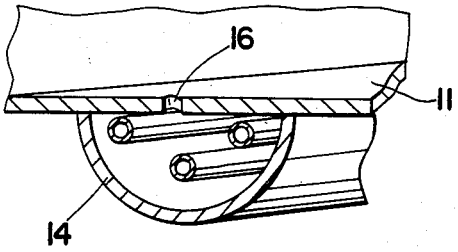
FIG. 4. A partial perspective of part of the invention is shown.
Figure 5:
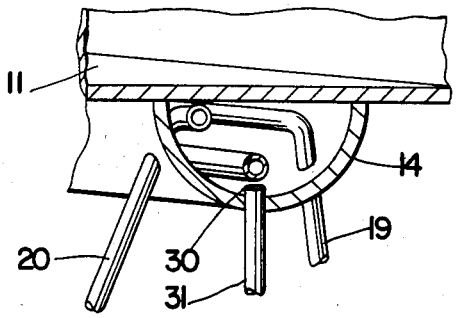
FIG. 5. A partial perspective of part of the invention is shown.

In FIG. 3, the various previously discussed elements are depicted. In FIG. 4, the outlet means, 30, connecting the output flow line, 31, to the spa-water circulator pump is shown in a partial sectional view in operative connection with the heat chamber, 14, and the seat appertures, 16. Likewise, in FIG. 5, the input flow line, 19, and the output flow line, 20, are shown in operative connection with the heat chamber, 14.

Having discussed all pertinent structural features of the present invention as aforesaid, the operation of said invention should be easily understood. Said invention consists generally of five major operational elements comprising, the spa vessel, 10, the heating chamber, 14, the water heating element, 18, the water pump, 21, and the spa-water circulator pump, 27, connected by appropriate connecting means which has been previously discussed. After the spa is initially filled with water or other fluids, the temperature of said fluid is increased by heat provided by the water heating element, 18. The water heating element, 18, being regulated by the thermostat, 23, and having its water circulated by the water pump, 21. The spa-water circulator pump, 27, causes a mixing action to occur in the spa shell thereby causing the water contained in the shell to be conducted over and about and through the heat chamber and the heat transfer conduits, 15, contained in the heat chamber, 4, so as to complete the transfer of heat from the water heating element, 18, to the water contained in the shell, 10.

It is obvious from the foregoing that the invention can be manufactured in many different embodiments. The foregoing discussion is meant to be for illustrative purposes only and is not be read as limiting the scope of the invention to only the embodiments(s) shown but should be read in light of the many obviously potential embodiments.

We claim:

1. A heated water holding receptable comprising, a spa shell having a heat chamber attached thereto, said heat chamber having heat transferring conduits therein, multiple appertures being provided between said heat chamber and said shell for the passage of water therethrough, a water heating element being connected to said conduit, said spa shell having a seat therein, said seat having said heat chamber adjacent thereto, said seat having appertures interconnecting said seat and said heat chamber, said heat transfer conduit being connected by closed conduits with said water heating element, said connecting conduit having therein a water pump, said water pump being thermostatically controlled according to the temperature of the water temperature contained in said spa shell, said spa shell having its water circulated through said heat chamber, said circulation being provided by a spa-water circulator pump, said spa-water circulator pump having connecting conduit means between said heat chamber and said spa shell, said spa-water circulator pump being thermostatically controlled by the same sensor as that which controls said water pump whereby said spa-water circulator pump and said water pump operate in unison.

2. The apparatus of claim 1, wherein the said apperatures of said spa shell are situated opposite to the input flow line of said spa-water circulator pump.

3. A method of heating a water receiving vessel, including the steps of:

a. providing a spa shell having a heat transfer chamber,
b. placing in said chamber acceptable heat transfer conduit,
c. passing heated water through said heat transfer conduit,
d. providing a water heating element,
e. providing a closed conduit system between said heat transfer conduit and said water heating element whereby a watertight transfer system is provided,
f. providing a water pump in said heat transfer conduit whereby the water is circulated,
g. attaching to said spa shell, a spa-water circulator pump having acceptable connecting means between said heat chamber and said spa shell whereby the water is circulated throughout said spa shell, and
h. having spa-water circulator pump be thermostatically controlled by the same sensor as that which controls said water pump whereby said spa-water circulator pump and said water pump operate in unison.

* * * * *